US009764180B2

(12) United States Patent
Bybee et al.

(10) Patent No.: US 9,764,180 B2
(45) Date of Patent: Sep. 19, 2017

(54) RESISTANCE TRAINER HAVING MULTIPLE INTERCONNECTED BODY ATTACHMENT POINTS

(71) Applicants: Dustin Bybee, West Point, UT (US); Clinton Bybee, Ogden, UT (US); Colten Bybee, West Point, UT (US)

(72) Inventors: Dustin Bybee, West Point, UT (US); Clinton Bybee, Ogden, UT (US); Colten Bybee, West Point, UT (US)

( * ) Notice: Subject to any disclaimer, the term of this patent is extended or adjusted under 35 U.S.C. 154(b) by 0 days.

(21) Appl. No.: 14/203,548

(22) Filed: Mar. 10, 2014

(65) Prior Publication Data

US 2015/0251038 A1 Sep. 10, 2015

(51) Int. Cl.

| | |
|---|---|
| ***A63B 21/02*** | (2006.01) |
| ***A63B 21/04*** | (2006.01) |
| ***A63B 21/055*** | (2006.01) |
| ***A63B 23/035*** | (2006.01) |
| *A63B 21/00* | (2006.01) |

(52) U.S. Cl.

CPC ..... *A63B 21/0442* (2013.01); *A63B 21/0552* (2013.01); *A63B 21/4009* (2015.10); *A63B 21/4025* (2015.10); *A63B 23/03541* (2013.01); *A63B 23/03575* (2013.01); *A63B 21/4011* (2015.10); *A63B 21/4013* (2015.10); *A63B 21/4017* (2015.10); *A63B 21/4021* (2015.10)

(58) Field of Classification Search

CPC ..... A63B 21/00; A63B 21/02; A63B 21/04; A63B 21/0407; A63B 21/0442; A63B 21/055; A63B 21/0552; A63B 21/0555; A63B 21/0557

USPC ..... 482/92, 121–126, 129–130

See application file for complete search history.

(56) References Cited

U.S. PATENT DOCUMENTS

| | | | | | |
|---|---|---|---|---|---|
| 650,656 | A * | 5/1900 | Raabe | A63B 21/0552 | 473/215 |
| 1,618,273 | A * | 2/1927 | Davidson | A63B 21/0004 | 482/124 |
| 2,613,932 | A * | 10/1952 | Manners | A63B 21/0552 | 482/124 |
| 4,019,734 | A * | 4/1977 | Lee | A63B 21/0552 | 482/125 |
| 4,948,117 | A * | 8/1990 | Burke | A63B 69/12 | 482/129 |

(Continued)

*Primary Examiner* — Loan H Thanh
*Assistant Examiner* — Garrett Atkinson
(74) *Attorney, Agent, or Firm* — Steven Rinehart

(57) ABSTRACT

A resistance system is configured to perform a resistance exercise for an axial base, such as a torso, and a longitudinal member, such as a leg and arm. The resistance exercise helps develop the longitudinal member and axial base by forcing the longitudinal member to pull against different, but constant tension forces, and also forcing the longitudinal member to maintain a proximal distance to the axial base. A short resistance member extends between a foundation mount on the axial base and an intermediate mount on the longitudinal member. A long resistance member extends from the foundation mount, joining with the intermediate mount, and attaching to a distal mount. The short resistance member generates greater tension force than the long resistance member when stretched. The multiple and independent connections made by resistance members create different tension forces for resistance exercises.

8 Claims, 5 Drawing Sheets

(56) References Cited

U.S. PATENT DOCUMENTS 5,040,788 A * 8/1991 Randall ..... A63B 21/0552 473/229
5,186,701 A * 2/1993 Wilkinson ..... A41D 13/0015 482/121
5,190,512 A * 3/1993 Curran ..... A63B 21/0004 482/122
5,203,754 A * 4/1993 Maclean ..... A63B 21/0004 482/121
5,336,151 A * 8/1994 Van Ballegooie . A63B 21/4025 482/121
5,362,295 A * 11/1994 Nurge ..... A63B 21/00061 482/121
5,372,565 A * 12/1994 Burdenko ..... A63B 21/4025 482/124
5,643,159 A * 7/1997 Iavarone ..... A63B 21/0004 482/125
5,647,827 A * 7/1997 Gutkowski ..... A63B 21/0004 482/122
5,683,336 A * 11/1997 Pape ..... A63B 21/0004 482/111
5,720,042 A * 2/1998 Wilkinson ..... A41D 13/0015 2/69
5,803,881 A * 9/1998 Miller ..... A63B 21/0004 482/124
5,993,362 A * 11/1999 Ghobadi ..... A63B 21/0004 482/121
6,099,446 A * 8/2000 Johnson ..... A63B 21/0004 482/124
6,287,242 B1 * 9/2001 Fray ..... A63B 21/0004 482/121
6,984,184 B2 * 1/2006 Gray ..... A63B 21/0004 473/458
7,608,026 B1 * 10/2009 Nicassio ..... A63B 21/00185 24/265 BC
7,744,511 B2 * 6/2010 Grigoriev ..... A61F 5/0102 482/121
7,833,140 B2 * 11/2010 Ligrano ..... A63B 21/00043 482/124
7,998,034 B1 * 8/2011 Cobo ..... A63B 69/0028 482/126
7,998,041 B1 * 8/2011 Johnson ..... A63B 21/0552 482/124
D698,877 S * 2/2014 Calvin ..... D21/692
2012/0202658 A1 * 8/2012 Menefee, Sr. ... A63B 21/00061 482/124

* cited by examiner

RESISTANCE TRAINER HAVING MULTIPLE INTERCONNECTED BODY ATTACHMENT POINTS

BACKGROUND

Field of the Invention

This invention relates to a resistance system that provides a resistance exercise along multiple points of a longitudinal member, and more particularly relates to a resistance system that extends outwardly from a foundation point on a human body to independently attach to an intermediate point and a distal point along a longitudinal member for simulating realistic movements during resistance exercises.

Description of the Related Art

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Often, a resistance band is used to increase range of motion and movement for activities such as jumping. The body is forced to exert tensile force on the bands. Torn muscle tissue is rebuilt, repaired and strengthened. The resistance band often comprises elongated polymeric tubing that provides a predetermined amount of tensile force when stretched across different areas of the body.

It is known that resistance bands offer low cost, portability, ease-of-use and versatility for performing a variety of resistance exercises relative to dumbbells and steel exercise machines. With their simple, low cost design elements and broad fitness and therapeutic applications, resistance bands have achieved wide acceptance among fitness and therapeutic professionals and become standard exercise equipment found in many fitness and therapeutic industries. A complete workout of most of the major muscle groups can be achieved with resistance bands.

Normally, resistance bands enable a user to exercise both sides of the body at once, thereby reducing the time needed for a full-body workout. However, during the resistance exercise different muscle groups may require different amounts of tensile force. For example, a bicep requires more tension to develop than a forearm. Additionally, the arms and legs are difficult to control while performing resistance exercises with the resistance band, since they have a tendency to flail away from the torso.

In view of the foregoing, it is clear that these traditional resistance bands are not perfect and leave room for more optimal approaches.

SUMMARY

From the foregoing discussion, it should be apparent that a need exists for a resistance system that provides enhanced resistance training and enables realistic simulation of movements during a resistance exercise. Beneficially, such an apparatus would provide a plurality of features and components efficacious for independently joining a foundation point on an axial base with an intermediate point and a distal point on a longitudinal member with variously sized and tensioned resistance members. Each independent connection creates different tension forces and also helps maintain the longitudinal member in proximity to the axial base while performing the resistance exercise. These features create a synergy that is efficacious for simulating realistic movements while performing resistance exercises along the longitudinal member.

The present invention has been developed in response to the present state of the art, and in particular, in response to the problems and needs in the art that have not yet been fully solved by currently available apparatus. The resistance system functions to perform a resistance exercise on an axial base and a longitudinal member. The resistance system connects a foundation point on the axial base to an intermediate point and a distal point on the longitudinal member with flexible, stretchable resistance members having different tension forces and lengths. The resistance exercise helps develop the longitudinal member and axial base by forcing the longitudinal member to pull against different, but constant tension forces, and also forcing the longitudinal member to maintain a proximal distance to the axial base. The connections may be formed with variously sized and tensioned resistance members, including a short resistance member and a long resistance member. Each independent connection made by the resistance members generates different tension forces on the respective longitudinal member, and also helps maintain the longitudinal member in proximity to the axial base for stability.

In some embodiments, the resistance members originate at a single foundation point on the axial base, and independently extend outwardly to attach to an intermediate point and a distal point located on the longitudinal member. The resistance system includes multiple attachment points on the longitudinal member. It is these multiple points, each having a different tension force and distance from the foundation point, which provides the novel resistance training benefits. Significantly, the resistance members generate tension force when pulled or stretched between the various attachment points. It is resistance to this tension force that provides the training and development for the resistance system.

The longitudinal member may include an arm and/or a leg that is joined with the axial base, such as a torso. Generally, the axial base provides the foundation of support, and the longitudinal member performs the resistance exercise for development and training. While performing the resistance exercise, the longitudinal member may move in various directions against the resistance created from resistance members that connect the axial base to multiple points on the longitudinal member. Multiple longitudinal members may perform the resistance exercise simultaneously. For example, a left arm, a right arm, a left leg, and a right leg, all attached to the foundation point with variously sized and tensioned resistance members.

A short resistance member and a long resistance member extend between the foundation point and the respective connection points on the longitudinal member. Each resistance member may provide a different length and tension for creating different resistances. The short resistance member extends between the foundation point and the intermediate point to help maintain the longitudinal member in proximity to the axial base. The long resistance member, while joining with the intermediate point, continues extending until attachment with the distal point. In this manner, a variety of resistance exercises by the longitudinal member simulates realistic movements and also maintains the longitudinal member in proximity to the axial base.

Accordingly, the present invention has been developed to provide a resistance system for creating tension and resistance exercises for training the longitudinal member, strengthening the axial base, and developing balance. The system includes a foundation mount that fastens to the foundation point on the axial base. An intermediate mount fastens to the intermediate point on the longitudinal member. A distal mount fastens to the distal point on the longitudinal member. The mounts may include bands that securely wrap around the respective axial base or longitudinal member. A short resistance member and a long resistance member extend between the mounts in a predetermined configuration.

In some embodiments, both the short resistance member and the long resistance member extend outwardly from the foundation mount. Each resistance member is independent and attaches to the mounts along the longitudinal member. The short resistance member extends to the intermediate mount for attachment through an intermediate fastener. The long resistance member extends further to the distal mount, passing through the intermediate fastener and attaching to a distal fastener. The variances in tension for each resistance member create a tension that simulates realistic movements during the resistance exercises. The double attachment to the intermediate mount and the single attachment to the distal mount help to retain the longitudinal member in proximity to the axial base.

In a first aspect, the resistance system having multiple attachment points for performing a resistance exercise comprises: a foundation mount disposed to join with a foundation point on an axial base; an intermediate mount disposed to join with an intermediate point on a longitudinal member; a distal mount disposed to join with a distal point on the longitudinal member; a short resistance member comprising a predetermined short tension, the short resistance member configured to attach the foundation mount to the intermediate mount; and a long resistance member comprising a predetermined long tension, the long resistance member configured to attach the foundation mount to the distal mount, the long resistance member further configured to join with the intermediate mount, whereby the multiple attachments to the intermediate mount help retain the longitudinal member in proximity to the axial base, whereby the predetermined short tension and the predetermined long tension generate different tensions for enhancing the resistance exercise.

In a second aspect, a human body may be exercised and stretched with the resistance system. The axial base may comprise a torso. The longitudinal member may comprise a left arm, and/or a right arm, and/or a left leg, and/or a right leg. The foundation point may comprise a hip. The intermediate point may comprise a bicep and/or a thigh. The distal point may comprise a wrist and/or an ankle.

In another aspect, the short resistance member provides greater tension force than the long resistance member. This variance in resistance creates a more realistic simulation of movement, and also exercises a larger variety of muscle groups.

In yet another aspect, the long resistance member passes through the intermediate fastener to form a first attachment, and then attaches to the distal fastener to form a second attachment. The two attachments from the long resistance member help restrain the longitudinal member proximally to the axial base, while also providing an additional resistance exercise.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to convey a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 1:
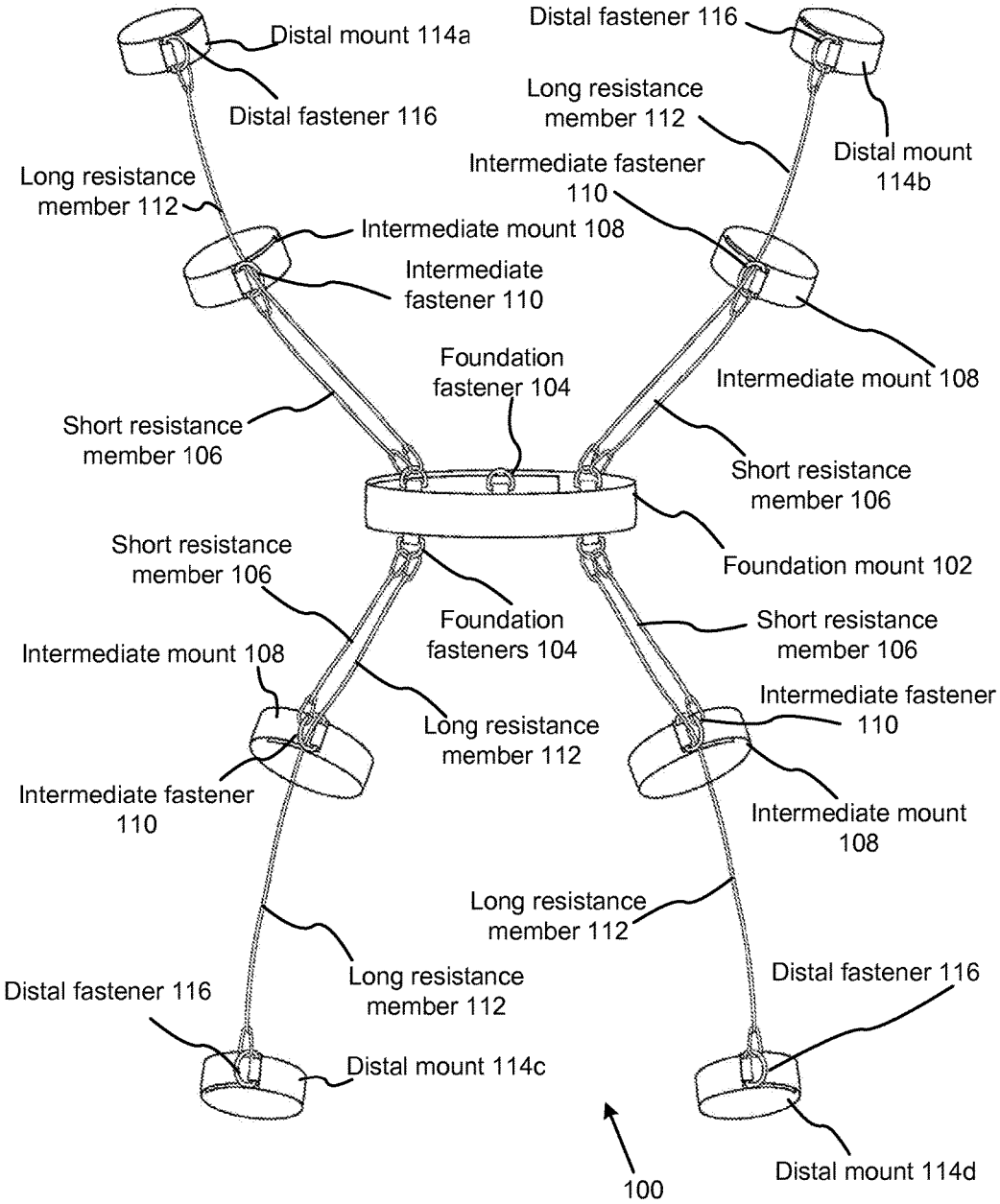
FIG. 1 is an elevational perspective view illustrating an exemplary resistance system, in accordance with the present invention.
Figure 2:
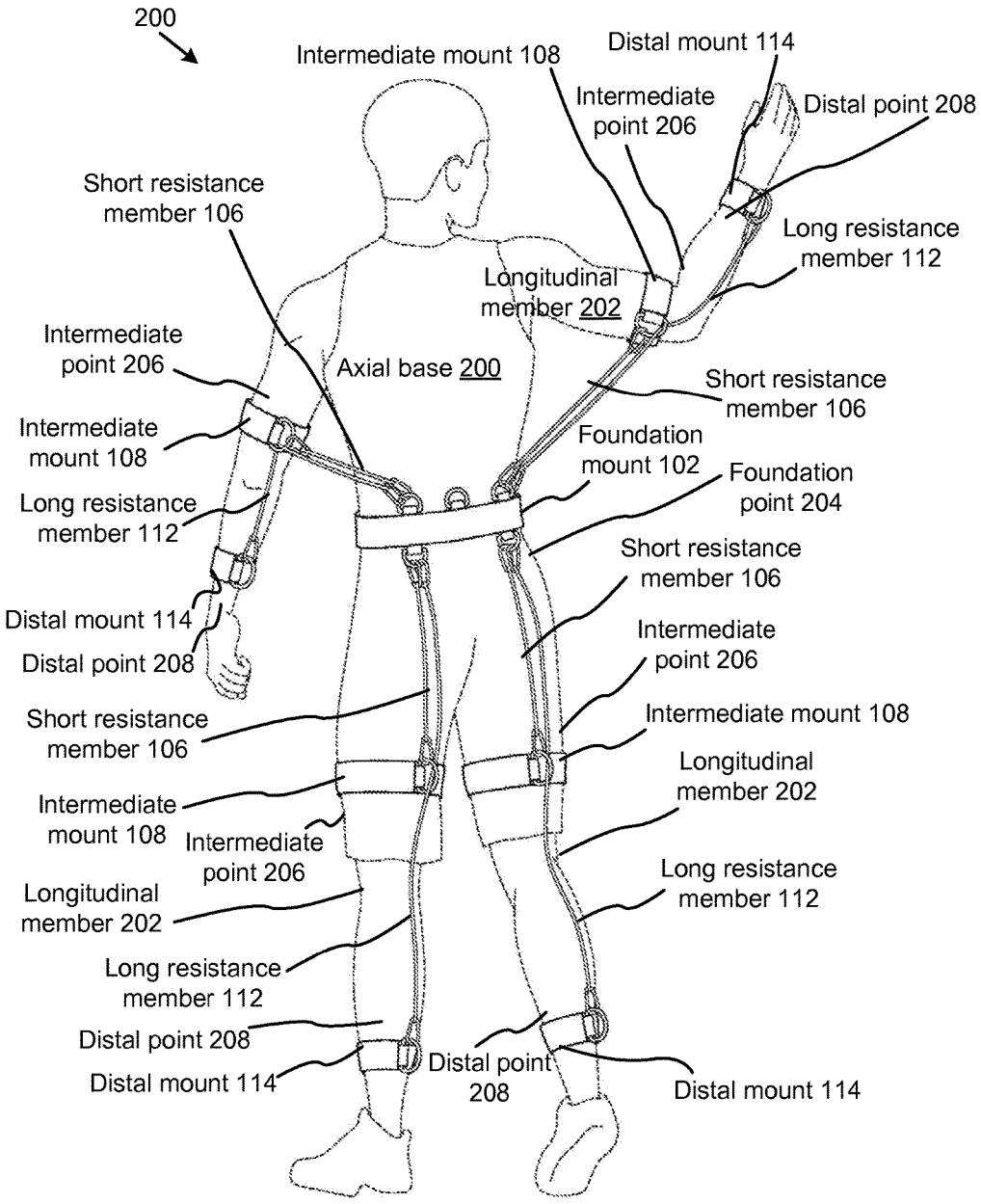
FIG. 2 is an environmental perspective view illustrating an exemplary resistance system having a foundation mount joined to a foundation point, four intermediate mounts joined with four intermediate points, four distal mounts joined with four distal points, four short resistance members, and four long resistance members, in accordance with the present invention.

FIGS. 1 and 2 are detailed perspective views illustrating an exemplary resistance system 100.

In one embodiment of the present invention, an exemplary resistance system 100 may be configured to perform a resistance exercise on a longitudinal member 202 and an axial base 200 for general training and development of specific areas along the longitudinal member 202 and the axial base 200. The resistance exercise helps develop the longitudinal member 202 and axial base 200 by forcing the longitudinal member 202 to pull against different, but constant tension forces. This exercise may build strength and dexterity. The resistance exercise may also develop balance and stability muscles, as the muscles are forced to maintain the longitudinal member 202 in proximity to the axial base 200. In some embodiments, the resistance system 100 may include stretchable resistance members 106, 112 that originate from a foundation point 204 on an axial base 200, and extend outwardly along a longitudinal member 202 to independently attach to an intermediate point 206 and a distal point 208. The resistance members 106, 112 comprise different lengths, tensions, and widths to form a kaleidoscope of resistance exercise options. The resistance members 106, 112 are generally portable and interchangeable.

As referenced in FIG. 1, a short resistance member 106 and a long resistance member 112 may extend between the foundation point 204 and the appropriate attachment points on the longitudinal member 202. The resistance members 106, 112 generate a tension force when pulled or stretched between the various points. It is resistance to this tension force that provides the training and development for the resistance system 100. Each resistance member 106, 112 may provide a different length and tension for creating the different tension forces. Both a short resistance member 106 and a long resistance member 112 attach to the intermediate point 206 to help maintain the longitudinal member 202 in proximity to the axial base 200. In this manner, a variety of resistance exercises by the longitudinal member 202 simulates realistic movements and also maintains the longitudinal member 202 in proximity to the axial base 200. The resistance members 106, 112 may include, without limitation, a rubber band, a stretch cord, a bungee cord, a latex cord, and a flexible bar. Suitable materials for the resistance members 106, 112 may include, without limitation, rubber, latex, nylon, and polyester. Those skilled in the art will recognize that the length, thickness, and material composition of the resistance members 106, 112 are determinative of the tension force generated while pulling and stretching the resistance members 106, 112. The resistance members 106, 112 may be interchanged and replaced to provide different types and difficulty levels of resistance exercises.

Turning now to FIG. 2, the longitudinal member 202 may include an arm and/or a leg that is joined with the axial base 200, such as a torso. Generally, the axial base 200 provides the foundation of support, and the longitudinal member 202 moves to perform the resistance exercise for development and training. While performing the resistance exercise, the longitudinal member 202 may move in various directions against the resistance created from resistance members 106, 112 that connect the axial base 200 to multiple points on the longitudinal member 202. The axial base 200 may include a torso. The foundation point 204 may include a hip. The intermediate point 206 may include a bicep and/or a thigh. The distal point 208 may include a wrist and/or an ankle. In this manner, various muscles throughout the torso, legs, and arms may be exercised and stretched using multiple tension forces, while also retaining the arms and legs in proximity to the torso for enhanced strengthening and stabilizing motions. Multiple longitudinal members 202 may perform the resistance exercise simultaneously. For example, a left arm, a right arm, a left leg, and a right leg, all attached to the foundation point 204 with variously sized and tensioned resistance members 106, 112.

Those skilled in the art, in light of the present teachings, will recognize that the resistance members 106, 112 may include elastic bands having sufficient tension to create a constant tension on the longitudinal member 202, thereby creating a sensation of more resistance during the resistance exercise. In one embodiment, the physical characteristics of the resistance members 106, 112 enable a user to keep constant tension on the muscles and joints during operation of the resistance system 100. Additionally, stabilizer muscles can be exercised through the resistance system 100 as the stabilizer muscles strain and stretch to keep the short resistance member 106 and the long resistance member 112 in alignment throughout each exercise.

However, in other embodiments, the resistance system 100 may be utilized to perform resistance exercises on an animal. For example, without limitation, each leg of the animal may be joined with the animal's torso to create a resistance there between. In yet another embodiment, a robot may utilize the resistance system 100, whereby the resistance members 106, 112 extend and stretch between the robot's arms and torso, and the robot's legs and torso. The resistance system 100 in this instance helps calibrate and program the robot arms and legs to apply a predetermined pressure for various functions. For example, the short resistance member 106, which has large tension force, generates sufficient tension force for training the robot to break objects, while the long resistance member 112, with less tension force, trains the robot arms to pick up small objects.

In yet another embodiment, the resistance system 100 may be used in the horticulture industry to orient and guide plants in a desired direction during growth. In this aspect, the resistance members 106, 112 extend from the plant stem to the individual branches or leaves. A predetermined tension force for each resistance member 106, 112 dictates the direction of growth for the plant. A short resistance member 106 with strong tension may keep the branches more vertically oriented, while a long resistance member 112 with weak tension force allows the branches to spread out more, in a horizontal direction. The multiple attachments also work to keep the branches in proximity to the stem. However, the resistance system 100 may be utilized with any animate or inanimate object having an axial base 200 and a longitudinal member 202 that require some form of resistance exercise.

In some embodiments, the resistance system 100 functions to perform a resistance exercise on an axial base 200 and a longitudinal member 202. The resistance system 100 comprises a short resistance member 106 and a long resistance member 112 that connect a foundation point 204 on the axial base 200 with an intermediate point 206 and a distal point 208 on the longitudinal member 202. The short resistance member 106 extends between the foundation point 204 and the intermediate point 206 to help maintain the longitudinal member 202 in proximity to the axial base 200. The long resistance member 112 also joins with the intermediate point 206, passing through an intermediate fastener 110, such as a loop. However, the long resistance member 112 continues extending until attaching with the distal point 208. In this manner, a variety of resistance exercises by the longitudinal member 202 simulates realistic movements and also maintains the longitudinal member 202 in proximity to the axial base 200.

The different connections by the short resistance member 106 and the long resistance member 112 may be formed with various lengths and tension forces. Each independent connection made by the resistance members 106, 112 generates different tension forces on the respective longitudinal member 202, and also helps maintain the longitudinal member 202 in proximity to the axial base 200 for additional stability. The resistance members 106, 112 originate at a foundation point 204 on the axial base 200, and independently extend outwardly to attach to an intermediate point 206 and a distal point 208 located on the longitudinal member 202.

The short resistance member 106 and the long resistance member 112 extend between the foundation point 204 and the respective connection points on the longitudinal member 202. Each resistance member 106, 112 may provide a different length and tension for creating different tension forces, and consequently enabling different styles and levels of difficulty for the resistance exercises. In one embodiment, the short resistance member 106 generates greater tension than the long resistance member 112. Both the short resistance member 106 and the long resistance member 112 attach to the intermediate point 206 to help maintain the longitudinal member 202 in proximity to the axial base 200. In this manner, a variety of resistance exercises by the longitudinal member 202 simulates realistic movements and also maintains the longitudinal member 202 in proximity to the axial base 200. In one embodiment the short resistance member 106 may comprise a length sufficient for connecting a hip to a thigh or bicep. The long resistance member 112 may be sufficiently sized to connect a hip to a wrist or ankle. In yet another embodiment, the long resistance member 112 may connect two separate longitudinal members 202, such as two ankles for performing lateral thigh development resistance exercises.

Accordingly, the present invention has been developed to provide a resistance system 100 for creating tension and resistance exercises for developing and training the longitudinal member 202. The system 100 includes a foundation mount 102 that fastens to the foundation point 204 on the axial base 200. The foundation mount 102 may include a belt that straps around the hip and secures through a hook and loop fastener, a buckle, a magnet, and a knot. An intermediate mount 108 fastens to the intermediate point 206 on the longitudinal member 202. A distal mount 114 fastens to the distal point 208 on the longitudinal member 202. The intermediate mount 108 and the distal mount 114 comprise bands that wrap around the respective point 206, 208. A short resistance member 106 and a long resistance member 112 extend between the mounts 104, 108, 114 in a predetermined configuration. However, in an alternative embodiment, a lateral resistance member may connect two distal mounts 114 on the wrist or the ankles. This configuration may enable a user to perform lateral resistance exercises.

In some embodiments, both the short resistance member 106 and the long resistance member 112 extend outwardly from the foundation mount 102. Each resistance member is independent and attaches to the mounts 108, 114 along the longitudinal member 202 (FIG. 2). The short resistance member 106 extends to the intermediate mount 108 for attachment through an intermediate fastener 110. The long resistance member 112 extends further to the distal mount 114, passing through the intermediate fastener 110 and attaching to a distal fastener 116. The variances in tension for each resistance member 106, 112 create a tension that simulates realistic movements during the resistance exercises. The double attachment to the intermediate mount 108 and the single attachment to the distal mount 114 help to retain the longitudinal member 202 in proximity to the axial base 200.

Figure 3:
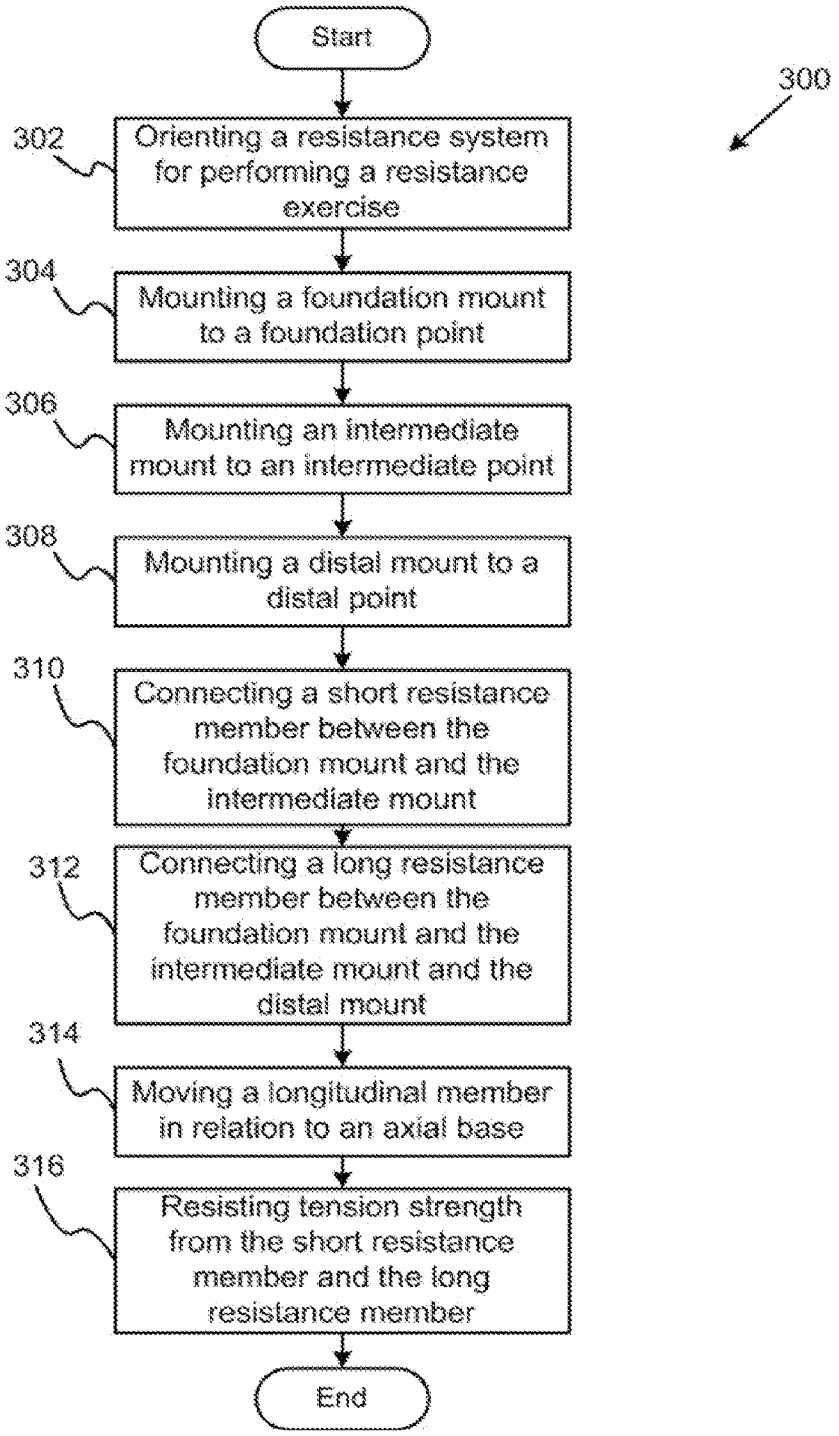
FIG. 3 illustrates a flowchart diagram of an exemplary method for performing a resistance exercise with a resistance system, in accordance with the present invention.

In operation, the resistance system 100 may be utilized by a user to perform a method 300 for performing a resistance exercise. FIG. 3 illustrates a flowchart diagram of the method 300. In one embodiment, the method 300 may include an initial Step 302 of orienting a resistance system 100 to performing a resistance exercise. The resistance system 100 generally is adorned and enables the short resistance member 106 and the long resistance member 112 to connect with multiple locations on the axial base 200 and the longitudinal member 202. The resistance system 100 is generally portable and interchangeable.

A Step 304 may include mounting a foundation mount 102 to a foundation point 204. The foundation mount 102 may include a belt that secures with a fastener, such as a hook and loop fastener, a buckle, a magnet, and a knot. The method 300 may then proceed to a Step 306 of mounting an intermediate mount 108 to an intermediate point 206. The intermediate mount 108 may include an intermediate band that straps to the bicep or thigh. In some embodiments, a Step 308 may include mounting a distal mount 114 to a distal point 208. The distal band may include a distal band that straps to the wrist or ankle.

A Step 310 comprises connecting a short resistance member 106 between the foundation mount 102 and the intermediate mount 108. The short resistance member 106 may attach to a foundation fastener 104 from a short resistance member proximal end, and attach to an intermediate fastener 110 from a short resistance member distal end. A Step 312 may include connecting a long resistance member 112 between the foundation mount 102 and the intermediate mount 108 and the distal mount 114. The long resistance member 112 creates the connection that retains the longitudinal member 202 in proximity to the axial base 200 during the resistance exercise. A long resistance member proximal end attaches to the foundation fastener 104, then passes through the intermediate fastener 110, such as a loop, and finally attaches from a long resistance member distal end to a distal fastener 116. This double attachment by the long resistance member 112 works to retain the longitudinal member 202 in proximity to the axial base 200. In other embodiments, the long resistance member 112 does not pass through an intermediate fastener 104 or any portion of the intermediate mount 108.

In another step, the method 300 may include a Step 314 of moving a longitudinal member 202 in relation to an axial base 200. The longitudinal member 202 may be moved, flexed, bent, stretched, manipulated, and myriad other movements that utilize the constant tension and forced proximity to the axial base 200 to develop the longitudinal member 202, strengthen the axial base 200, and develop stabilizing members on the longitudinal member 202. A final Step 316 includes resisting tension force from the short resistance member 106 and the long resistance member 112. The resistance system 100 is used to increase range of motion and movement. The resistance members 106, 112 work by making the axial base 200 and the longitudinal member 202 work harder on the areas where the resistance members 106, 112 are attached and, in one embodiment.

In one alternative embodiment, the long resistance member 112 may extend between the foundation mount 102 and a head mount to provide resistance training to a neck muscle. The head can be rotated, pivoted, and moved to resist the tension force from the long resistance member 112. In yet another alternative embodiment, the long resistance member 112 may extend from the foundation mount 102 to a surface, such as a wall mount or a floor mount. The user may then walk away from the wall, and thus, the tensile force created there from, to develop leg muscles.

Figure 4:
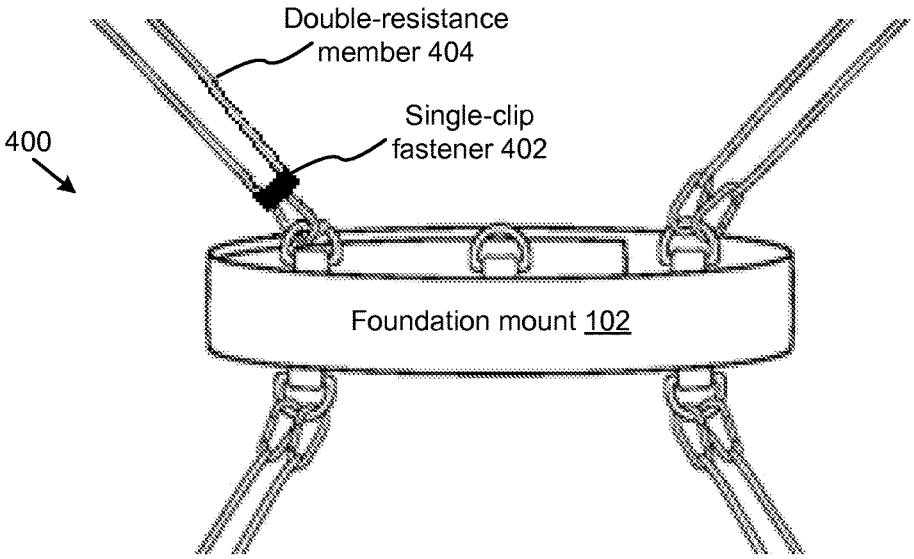
FIG. 4 is an exploded, elevational perspective view illustrating an exemplary resistance device, in accordance with the present invention.

FIG. 4 is an exploded, elevational perspective view illustrating an exemplary resistance device 400, in accordance with the present invention. The resistance device 400 comprises a foundation mount 102, a single-clip fastener 402 and a double-resistance member 404.

As shown, the resistance device 400 may comprise a single clip fastener 402 which conjoins a short resistance member 106 and a long resistance member 112 and interlocks these combined members 106, 112 with a foundation fastener 104. In other embodiments, the resistance device 400 comprises a double-resistance member 404 which comprises the single-clip fastener 402.

In various embodiments of the present invention, the resistance device 400 comprises two foundation mounts 102. One may be detachably enabled to strap around a user's chest while another may be enabled to strap around a user's waste, or other area of the body. These foundation mounts 102 may, or may not, be detachably or permanently affixed using straps or other means known to those of skill in the art.

The bands or resistance members 106, 112 and 404 may connect to any fastener 104 on the device 400 to create any type of resistance possible.

In various embodiments of the present invention, the short resistance members 106 are configured (for a certain body-shape) to create the same, or nearly the same, tensile resistance over a given movement of a user while wearing the device 400.

Figure 5:
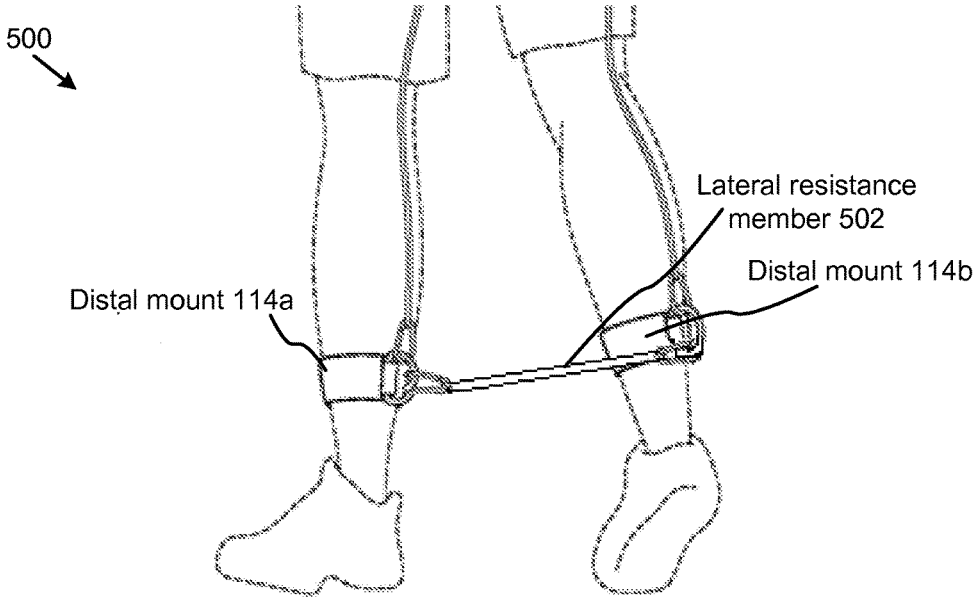
FIG. 5 is an exploded, elevational perspective view illustrating an exemplary resistance device, in accordance with the present invention.

FIG. 5 is an exploded, elevational perspective view illustrating an exemplary resistance device 500, in accordance with the present invention. The resistance device 500 comprises a distal mount 114*a*, a distal mount 114*b*, and a lateral resistance member 502.

The lateral resistance member 502 interconnects distal mounts 114*a-b* directly. The lateral resistance member 502, like the other resistance members 106, 112, 404, comprises an elongated polymeric tubing and detachable clips for connecting to fasteners 104. The lateral resistance member 502 provides optionally improved functionality to the device 500 for hamstring exercise and other muscles and muscle groups in the legs.

Figure 6:
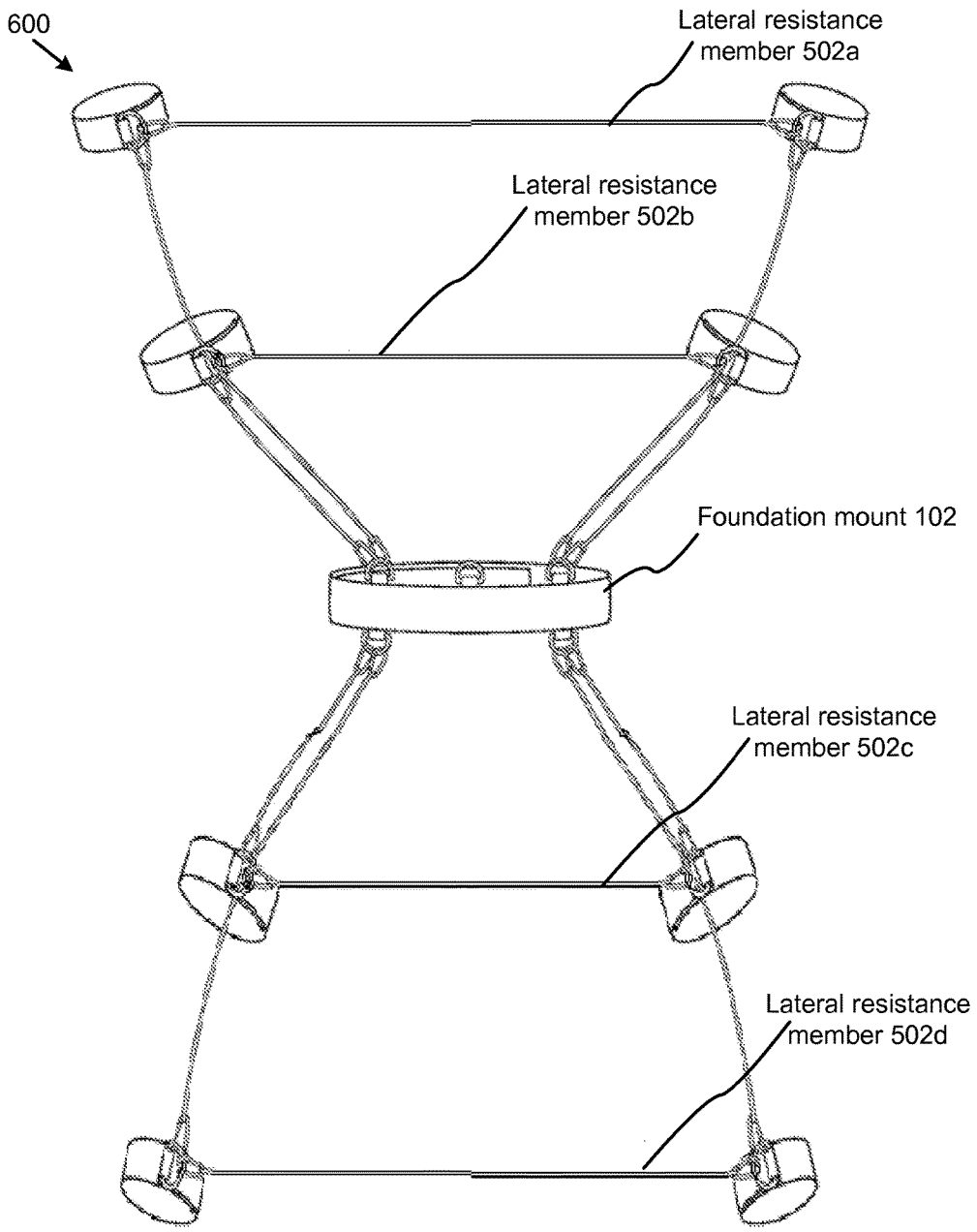
FIG. 6 is an elevational perspective view illustrating an exemplary resistance apparatus, in accordance with the present invention.

FIG. 6 is an elevational perspective view illustrating an exemplary resistance apparatus 600, in accordance with the present invention. The resistance apparatus 600 comprises lateral resistance members 502*a-d*.

The shown apparatus 600 comprises four lateral resistance members 502*a-d*. Each lateral resistance member 502*a-d* interconnects distal mounts 114. Although each of the shown lateral resistance members 502 interconnects another parallel distal mount 114, the lateral resistance members 502 may interconnect any distal mount 114 or intermediate mount 108.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A resistance apparatus having multiple attachment points for performing a resistance exercise, the resistance system comprising:

a foundation mount adapted to strap around a user's waist;

four intermediate mounts, each intermediate mount adapted to be attached to an intermediate point on one of the user's arms or legs;

four distal mounts, each distal mount adapted to be affixed to one of the user's wrists or ankles;

four short resistance members comprising a predetermined short tension, the short resistance members configured to attach the foundation mount to the intermediate mounts; and four long resistance members comprising a predetermined long tension, the long resistance members configured to attach the foundation mount to the distal mounts, the long resistance members further configured to slidably join with a respective intermediate mount;

a first detachable lateral resistance member for interconnecting two of the distal mounts:

a second detachable lateral resistance member for interconnecting two of the intermediate mounts:

whereby multiple attachments to the intermediate mounts help retain the user's arms and legs in proximity to the user's torso;

whereby the predetermined short tension and the predetermined long tension generate different tensions for enhancing the resistance exercise.

2. The apparatus of claim 1, wherein the foundation mount comprises a belt configured to wrap around the user's waist.

3. The apparatus of claim 2, wherein the belt comprises at least one foundation fastener for attaching to a short resistance member proximal end and a long resistance member proximal end.

4. The apparatus of claim 1, wherein each intermediate mount comprises an intermediate band configured to wrap around one of an arm and a leg.

5. The apparatus of claim 1, wherein the intermediate mounts each comprise an intermediate band comprising an intermediate fastener adapted to be attached to a short resistance member distal end.

6. The apparatus of claim 1, wherein each intermediate point comprises one of an elbow and thigh.

7. The apparatus of claim 1, wherein each distal mount comprises a distal band configured to wrap around one of an arm and a leg.

8. The apparatus of claim 1, wherein each short resistance member exerts a greater tensile force than one of the long resistance members.

* * * * *